US007131466B2

(12) United States Patent
Speich et al.

(10) Patent No.: US 7,131,466 B2
(45) Date of Patent: Nov. 7, 2006

(54) PATTERNED SCARF, METHOD AND LOOM FOR PRODUCING THE SAME

(75) Inventors: Francisco Speich, Gipf-Oberfrick (CH); Christian Kuoni, Zeiningen (CH)

(73) Assignee: Brevitex Etablissement Pour L'Exploitation De Brevets Textiles (LI)

( * ) Notice: Subject to any disclaimer, the term of this patent is extended or adjusted under 35 U.S.C. 154(b) by 330 days.

(21) Appl. No.: 10/343,089

(22) PCT Filed: Mar. 21, 2001

(86) PCT No.: PCT/CH01/00176

§ 371 (c)(1),
(2), (4) Date: Jan. 24, 2003

(87) PCT Pub. No.: WO02/07550

PCT Pub. Date: Jan. 31, 2002

(65) Prior Publication Data

US 2003/0127150 A1 Jul. 10, 2003

(30) Foreign Application Priority Data

Jul. 24, 2000 (CH) ..... 1453/00

(51) Int. Cl.
*A42B 5/00* (2006.01)
*D03D 15/00* (2006.01)

(52) U.S. Cl. ..... 139/420 A; 2/207; 139/448; 139/447; 442/199; 428/370

(58) Field of Classification Search ..... 2/207; 139/420 A, 448, 447; 442/199; 428/370
See application file for complete search history.

(56) References Cited

U.S. PATENT DOCUMENTS 1,335,627 A * 3/1920 Waterfield ..... 87/10
1,475,659 A * 11/1923 Strohmeier ..... 139/383 R
1,775,346 A * 9/1930 Herrmann ..... 428/44
1,792,460 A 2/1931 Davis
1,967,054 A * 7/1934 Grean ..... 33/12
2,141,386 A * 12/1938 Kameel ..... 28/146
2,559,341 A * 7/1951 Brierley ..... 139/419
3,053,609 A * 9/1962 Miller ..... 8/128.1
3,286,739 A 11/1966 Itakura
3,471,867 A * 10/1969 Kirchhoff ..... 2/207
4,209,559 A * 6/1980 Wada et al. ..... 428/91
5,115,839 A 5/1992 Speich
5,401,555 A * 3/1995 Yamakita ..... 428/99
5,826,275 A * 10/1998 Rachel et al. ..... 2/144
6,016,573 A * 1/2000 Olson ..... 2/207
6,065,156 A * 5/2000 Murphy ..... 2/207
6,161,596 A * 12/2000 Swers et al. ..... 139/420 A
6,256,793 B1 * 7/2001 Arias et al. ..... 2/207
6,418,563 B1 * 7/2002 Turner ..... 2/239

(Continued)

FOREIGN PATENT DOCUMENTS

AU 42231/96 8/1996

(Continued)

*Primary Examiner*—John J. Calvert
*Assistant Examiner*—Robert H Muromoto
(74) *Attorney, Agent, or Firm*—Wolff & Samson PC; Klaus P. Stoffel

(57) ABSTRACT

A patterned scarf having a first fabric layer and a second fabric layer which are interwoven along the edges. The scarf has colors and/or patterns which are formed by weft threads their inserted spaced-out between warped threads of the same color. The warped threads are a textured yarn composed of chemical fibers.

17 Claims, 4 Drawing Sheets

U.S. PATENT DOCUMENTS

| | | | | |
|---|---|---|---|---|
| 6,423,409 | B1 * | 7/2002 | Swers et al. | 428/370 |
| 6,524,349 | B1 * | 2/2003 | Wittig | 8/137.5 |
| 6,716,778 | B1 * | 4/2004 | Hottner | 442/199 |
| 6,739,159 | B1 * | 5/2004 | Sciacca | 66/8 |
| 6,797,352 | B1 * | 9/2004 | Fowler | 428/57 |
| 6,907,759 | B1 * | 6/2005 | Sciacca | 66/171 |

FOREIGN PATENT DOCUMENTS

| | | | |
|---|---|---|---|
| DE | 88 07 555.9 | | 10/1988 |
| EP | 076 405 | A1 | 4/1983 |
| EP | 534 300 | A1 | 3/1993 |
| FR | 1 136 506 | | 5/1957 |
| FR | 1 148 627 | | 3/1959 |
| FR | 1 292 339 | | 11/1961 |
| FR | 2 247 995 | | 5/1975 |
| FR | 2 737 227 | | 1/1997 |
| GB | 1 489 740 | | 10/1977 |
| IT | 1 292 000 | A | 5/1997 |
| JP | 5 140 838 | | 6/1993 |
| JP | 8-158 193 | | 6/1996 |
| JP | 2000 45146 | | 2/2000 |
| WO | WO 89/02491 | | 3/1989 |

* cited by examiner

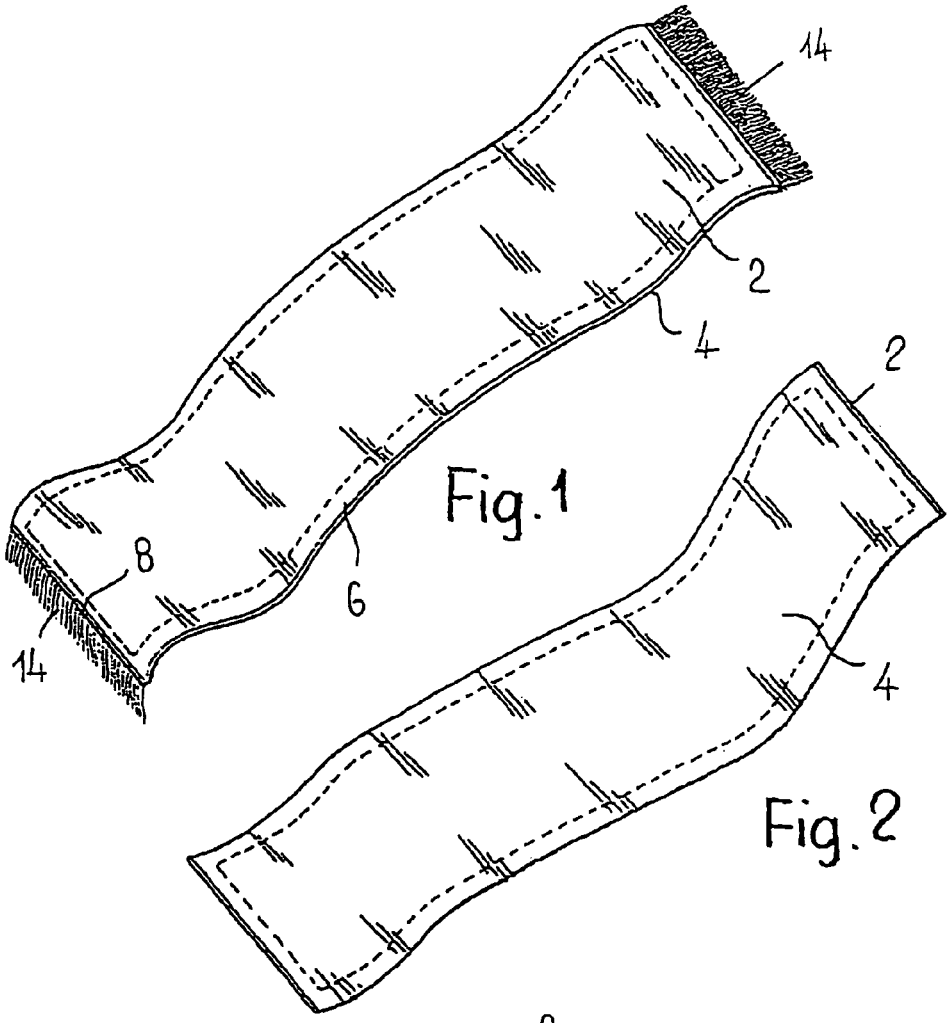
Fig. 1
Fig. 2
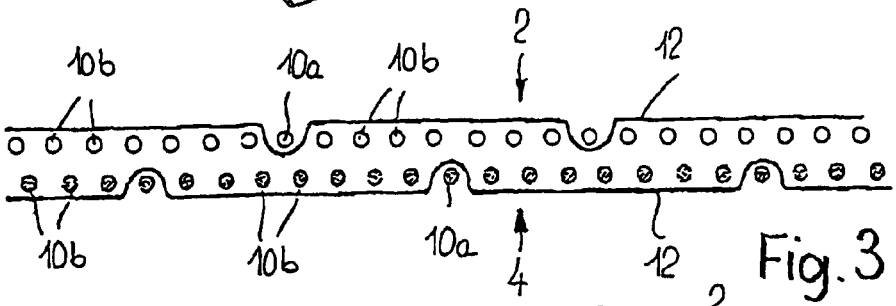
Fig. 3
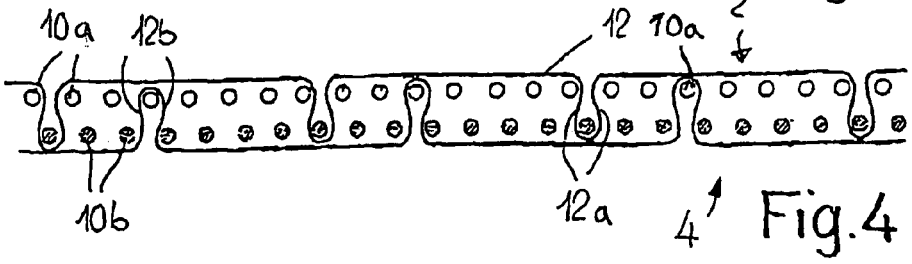
Fig. 4

PATTERNED SCARF, METHOD AND LOOM FOR PRODUCING THE SAME

PRIORITY CLAIM

This is a U.S. national stage of application No. PCT/CH01/00176, filed on Mar. 21, 2001. Priority is claimed on that application and on the following application: Country: Switzerland, Application No.: 1453/00, Filed: Jul. 24, 2000.

TECHNICAL FIELD

The invention relates to a patterned scarf. Such a scarf is suitable, in particular, as a fan's scarf for associations, clubs, companies and the like.

PRIOR ART

Scarves, in particular fan scarves, are known in large numbers.

One way of producing such scarves is by knitting a scarf web which is then folded over itself and stitched together along a longitudinal side. Such a scarf then has to be overturned so that the good side is outward. The scarf has soft edges and can be produced from various materials. However, such a scarf has only a very low thread or stitch density, with the result that only rough patterns can be produced. It is not possible to individualize from one scarf to the next. Any fringes have to be produced separately and stitched on at the ends of the scarf.

Another known way of producing such scarves is by weaving with the warp-and-weft effect. The scarf is produced from two fabric layers which are woven with multicolored warp threads and multicolored weft threads. These layers are interwoven at the edges. The scarves are cut mechanically along the longitudinal edges and stitched over with an overlock seam, in order to prevent fraying. Such scarves produced with the warp-and-weft effect have only low warp density and weft density and therefore make it possible to have only rough patterns with insufficient definition. It is not possible for the scarves to be individualized during the production method. Fringes are formed by means of projecting warp threads in the course of the production of the scarf, but the fringes are ugly since they are multicolored.

A scarf of the type initially mentioned is known from IT-1 292 000 A and is illustrated in the present FIGS. 1 to 4. This scarf has single-colored warp threads and the patterning is formed by means of multicolored weft threads by spaced-out insertions between the single-colored warp threads. Such a scarf makes it possible to have patterns with good definition and a good purity of the colors and patterns.

PRESENTATION OF THE INVENTION

The object of the invention is to improve further a patterned scarf of the type initially mentioned.

Pursuant to this object, and others which will become apparent hereafter, one aspect of the present invention resides in a patterned scarf having a first fabric layer and a second layer which are interwoven along the edges. The scarf has colors and/or patterns which are formed by weft threads by spaced-out insertions between warp threads of the same color. The warp threads consist of a textured yarn composed of chemical fibers.

the patterned scarf according to claim 1;

the method for producing the patterned scarf according to claim 16; and a weaving machine for carrying out the method according to claim 24.

The textured warp threads give the scarf attractive full fringes which come close to those of a knitted scarf. Moreover, the scarf itself acquires a fuller handle.

Such a scarf may, in principle, be produced from a single web, but it is more advantageous to have at least two-web production on a weaving machine and the separation of the interconnected scarves by means of a separating device. An efficient production of the scarf can thereby be implemented.

A weaving machine for producing the scarf has a jacquard or heddle frame device for shedding, a weft insertion device with a thread selection device, a cloth holding-down device or a temple, a separation device in the longitudinal direction, a cloth take-up and a computer controller.

Various textured yarns are suitable for the warp threads, such as, for example, tortionally textured yarns, shoved and crimped yarns, curled monofilaments textured via a knife edge, airjet-textured loop yarns and the like. It is particularly preferred, however, to have a yarn which has essentially nontwisted fibers lying open in parallel and which is swirled at defined intervals. Such yarns, despite having high stability in the longitudinal direction which is advantageous for fabric stability, nevertheless have a textured bulky appearance which is suitable for the fringes. The swirling of the fibers of the textured yarn may fluctuate within wide ranges, but a range of between 0.8 and 1.2 cm is particularly preferred. A wide range is also possible for the fineness of the yarn of the warp threads, namely 55 to 550 dtex, with preferred results being obtained with the fineness of 160 to 180 dtex.

Particularly in the ease of a yarn of the abovementioned type, optimum patterning possibilities with warp densities of 40 to 60, preferably 48, threads/cm or weft densities in each fabric layer of 20 to 36 threads/cm are obtained. Yarns composed of chemical fibers of the most diverse possible types may be used for the scarf, the warp threads preferably consisting of polyester or polyamide. Particularly suitable weft threads consist of acrylic, preferably acrylic staple fibers.

Although the patterning of the scarf is formed basically by the weft threads and their spaced-out insertion between the warp threads, it may be expedient, if appropriate, to provide the scarf with an additional weave-related patterning by means of the warp threads.

It is possible, admittedly, to produce each fabric layer so as to be individually patterned. A refinement according to the invention that provides that during the color change and/or pattern change of a pattern part the weft threads run from one fabric layer to the other fabric layer so as to connect them, is particularly advantageous, however, since the same weft threads can then be used for both fabric layers for patterning purposes. This affords the further advantage that, by the weft threads being changed from one fabric layer to the other, the individual fabric layers are interconnected in regions, with the result that the scarf acquires some stability which improves the serviceability and handle of the scarf.

According to a further embodiment of the invention, the scarf may have both a word region and a picture region, the weft threads of the two regions being different in terms of fineness and material, the weft threads preferably having greater fineness in the picture region.

According to another embodiment, it is advantageous if the scarf has an individually configurable pattern region, so that such a scarf can be provided during the weaving operation, for example, with the signature of the future user or of a particular idol.

The unraveling of the scarf or a reworking of the scarf, for example by the edges being stitched together, can be avoided if the scarf is constructed so that at least the first and the last weft thread along the transverse edges is an adhesive thread which connects the crossing warp threads, and which preferably consists of thermoplastic material.

The fringes along the transverse edges are formed by the warp threads. In specific instances, it may be advantageous if the scarf also has fringes along the longitudinal edges formed by projecting weft threads. The scarf can also be roughened so that it acquires a full velvet-like appearance and a corresponding pleasant handle and good wearing properties.

The separation of a plurality of scarves produced, multicolored, may be carried out by means of various separating devices. Thus, according to one embodiment, a mechanical separating device is possible. A thermal separating device is particularly effective, but usually leaves behind along the cut edges brows which may be sharp-edged and sawtooth-like and, as a rule, have to be eliminated, so that they are not detrimental to the wearability of the scarf for the user. It is particularly advantageous, therefore, in order to separate the webs to use an ultrasonic separating device which makes it possible to treat the cut edges even during cutting.

To produce the fringes along the longitudinal edges, it is advantageous not to arrange any warp threads in the region provided for forming the fringes and by means of a separating device to cut the continuous weft threads to the length of the fringes to be formed. In principle, all the separating methods may be carried out in separate operations after the weaving machine, but it is more advantageous if the separating operations are carried out directly on the weaving machine. According to a further embodiment of the inventive method, it is also advantageous to subject the scarves to thermosetting after weaving and separation on the weaving machine, in order to eliminate stresses in the fabric and set the fabric. Advantageously, the scarves can be cut off to the desired length from the running scarf web on the weaving machine.

BRIEF DESCRIPTION OF THE DRAWINGS

The nearest prior art is illustrated in FIGS. 1 to 4 and exemplary embodiments are described below in FIGS. 5 to 9 with the aid of the drawings in which:

FIG. 1 shows a diagrammatical illustration of a known scarf with fringes;

FIG. 2 shows the scarf of FIG. 1 in a reversed illustration and without fringes;

FIG. 3 shows a detail of the central region of the known scarf in cross section and on a larger scale;

FIG. 4 shows a detail of the edge region of the known scarf in cross section and on a larger scale;

DETAILED DESCRIPTION OF THE PREFERRED EMBODIMENTS

Figure 5:
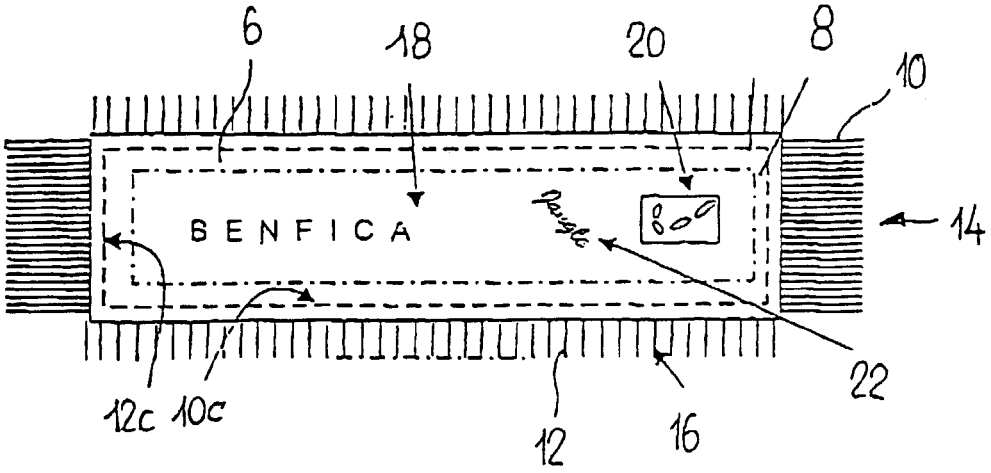
FIG. 5 shows a plan view of the scarf according to the invention.
Figure 6:
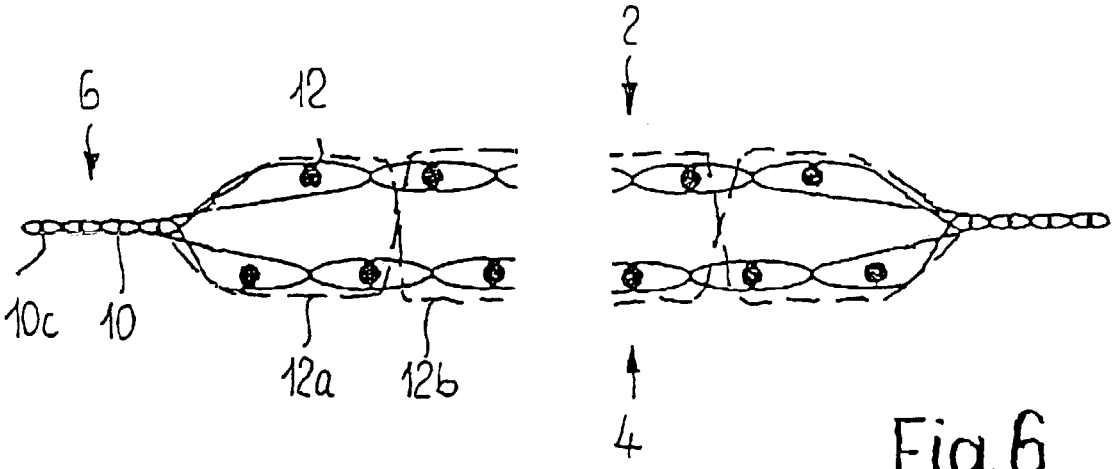
FIG. 6 shows a detail of the scarf according to the invention in cross section and on a larger scale.

FIGS. 1 to 4 show the prior art which is also relevant for the present invention and on which the present invention is based. The scarf illustrated in the figures contains a first fabric layer 2 and a second fabric layer 4 which are interwoven along the longitudinal edges 6 and along the transverse edges 8 and thus form a tube closed all-round. Each of the two fabric layers 2, 4 is formed by single-colored warp threads 10, which are independent of the colours to be produced on the scarf, and by multicolored weft threads 12. As can be gathered particularly from FIG. 3, the weft threads 12 are inserted, spaced out, between the warp threads 10, that is to say the weft thread, only in the case of specific warp threads 10*a*, is crossed with these and, in the case of the warp threads lob located between them, lies over these, that is to say covers the warp threads 10*b* and lies into the region above the warp threads which are to form the pattern. The weave of the weft threads at the warp threads travels on laterally from pick to pick by the amount of at least one warp thread. The warp threads 10 thus appear on the surface at solely spatial and pre-programmed intervals and are at the same time dominated by the weft threads, so that the latter indicate the color and pattern of the fabric and force the warp threads into the background.

FIG. 4 shows a detail of a longitudinal edge 6 of the scarf along which the fabric layers 2,4 are interwoven. In this case, the weft thread portions 12*b* of the first fabric layer 2 are connected to warp threads 10*b* of the second fabric layer 4 and weft thread portions 12*b* of the second fabric layer 4 are connected to warp threads 10*a* of the first fabric layer 2.

The weft threads determine the color and pattern on the good sides of the fabric layer 2, 4. Along the transverse edges 8, the warp threads 10 are free of weft threads and thus form fringes 14.

Preceding from the prior art outlined above, improvements of the present invention, as compared with this prior art, are described in FIGS. 5 to 9. The reference symbols used in FIGS. 1 to 4 are also used below.

FIG. 5 describes a scarf according to the invention, in which the fabric layers 2, 4 are interwoven along the longitudinal edges 6 and along the transverse edges 8. Along the longitudinal edges, in each case, at least the outer warp threads are designed as adhesive warp threads 10*c* which connect the crossing weft threads 12 to the warp threads 10. In a similar way, at least the first and the last weft thread along the transverse edges 8 are designed as adhesive weft threads 12*c*. For illustrative reasons, FIG. 5 illustrates the adhesive warp threads 10*c* and the adhesive weft threads 12*c* at some distance from the verge, but, in actual fact, they form the outer verge of the longitudinal edges 6 and of the transverse edges 8, as may be gathered from FIG. 6.

The warp threads 10 form the fringes 14 along the transverse edges. In the present example, fringes 16 are likewise present along the longitudinal edges 6, said fringes being formed by weft threads 12 which project above the longitudinal edges 6 to the desired length and are free of warp threads. The scarf illustrated in FIG. 5 has three different pattern regions. A first pattern region 18 is a lettering region which is reserved, for example, for the name of an association, club, company or the like, such as, for example, here, the football club BENFICA. A second pattern region 20 is a picture region which may contain, for example, the coat of arms or other design. The third pattern region 22 is an individual region which may, for example, be changed from scarf to scarf, with the first and second pattern regions 18, 20 otherwise being the same, and may contain, for example, the name of the wearer or the name of a sportsperson or the like. While a rougher screen definition may be envisaged for the first pattern region 18, the second pattern region 20 and the third pattern region 22 require a finer screen definition which can be achieved, for example, by means of thinner warp threads and a higher weft density.

It is possible, in principle, for the patterning of the individual fabric layers 2, 4 to be carried out individually for each fabric layer, as shown, for example, by reference to FIG. 3. It is more advantageous, however, if the patterns of the first fabric layer 2 and of the second fabric layer 4 are combined with one another, so that the pattern-forming weft threads 12*d* and 12*e* run, at the end of a pattern part, from one fabric layer to the other fabric layer. As a result, the negative image of the first fabric layer is formed on the second fabric layer, and, at the same time, the fabric layers are connected to one another during the change of the pattern parts, as may be gathered from FIG. 6.

Figure 7:
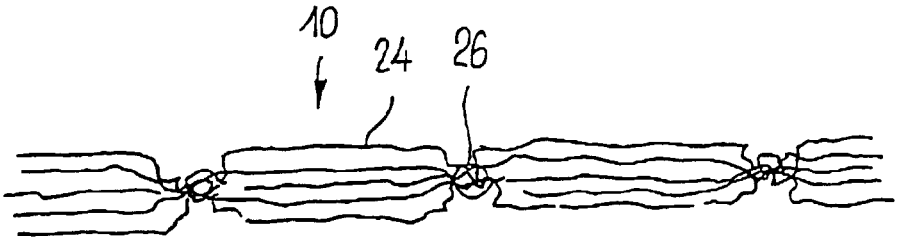
FIG. 7 shows a warp thread on a larger scale.

The warp threads are expediently formed from a textured yarn according to FIG. 7 which has fibers 24 lying essentially open in parallel and connected to one another at specific intervals by swirling 26. These swirlings may have intervals of 0.5 to 5 cm, but an interval of 0.8 to 1.2 cm is preferred. The warp threads may have a fineness of 55 to 550 dtex, but particularly good results have been achieved with finenesses of 160 to 180 dtex. The warp density is 40 to 60, preferably 48 threads per cm. The weft density advantageously amounts, in each fabric layer, to 20 to 36 threads per cm. Yarns composed of polyester or polyamide are preferably used as warp threads. Yarns composed of acrylic, preferably of acrylic staple fibers, have proved appropriate for the weft threads.

Figure 8:
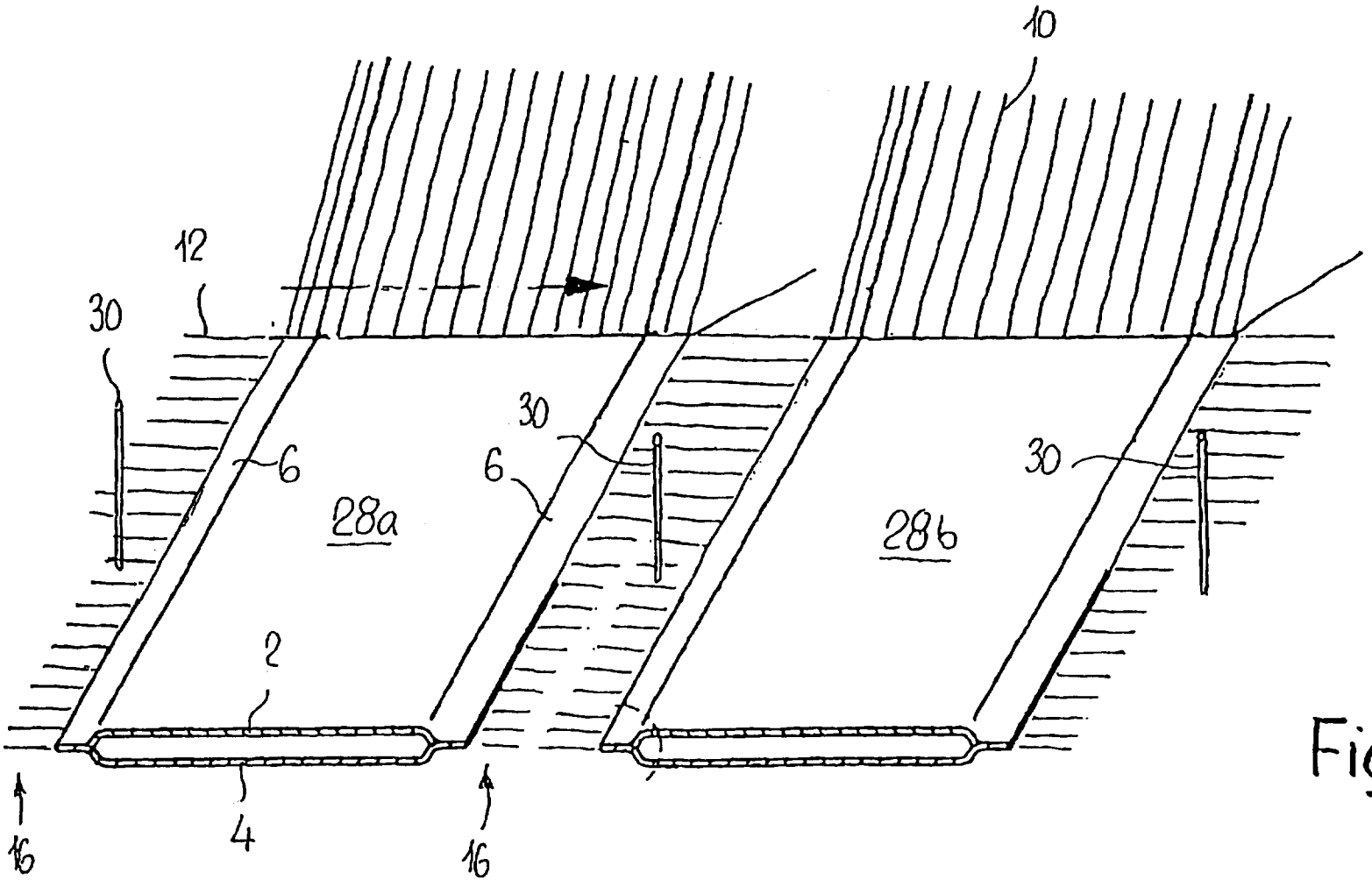
FIG. 8 shows the two-web production of a scarf with fringes along the longitudinal edges in a diagrammatic illustration.

The production of a scarf of the present type may take place from a single web on weaving machines. A two-web and multiweb production of the scarves, as indicated in FIG. 8, is preferred. FIG. 8 shows the two-web production of scarves which have fringes 16 along the longitudinal edges 6. The scarves 28*a* and 28*b* are produced in one piece, the weft threads 12 running continuously over both scarves 28*a* and 28*b*. In the region where the fringes 16 are to be formed, the warp threads 10 are cut out. Separating devices 30 separate the continuous weft threads 12 between the scarves 28*a*, 28*b*, in order to obtain the fringes 16 of the desired length. When scarves without fringes 16 along the longitudinal edges 6 are to be produced, the scarves are interwoven and the fabric is severed between the scarves by means of corresponding separating devices 30. The separating operation may be carried out by means of separating devices of the most diverse possible types, such as, for example, by means of mechanical or thermal separating devices or ultrasonic separating devices. The latter are preferred, since they make it possible to have a reliable separating operation and at the same time deliver smooth cut edges, in contrast to a thermal cutting device which directly delivers sharp brows.

Figure 9:
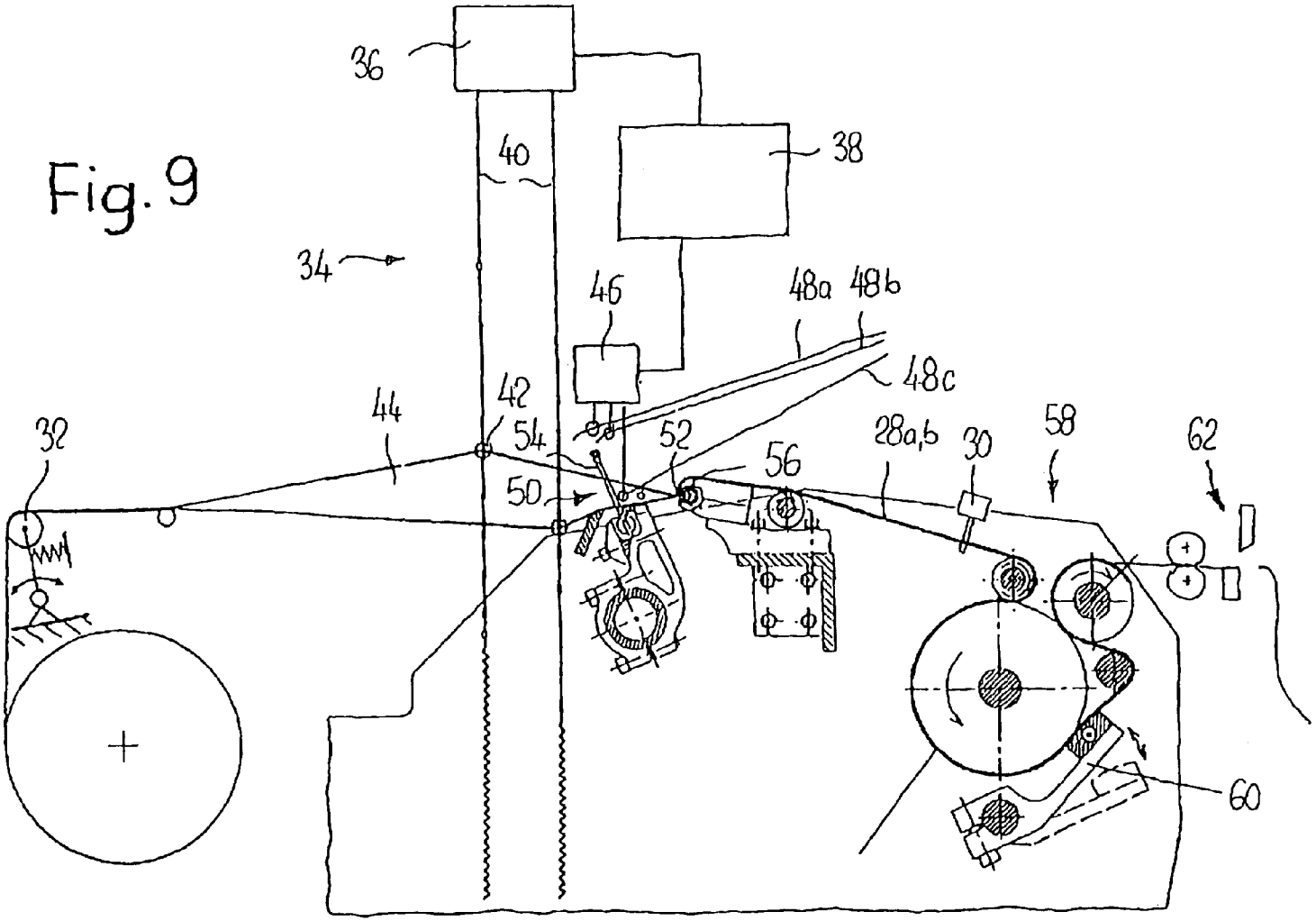
FIG. 9 shows a weaving machine for producing the scarf according to the invention in a diagrammatic illustration and in vertical section.

FIG. 9 shows a diagrammatical illustration of a weaving machine for producing the scarves 28*a*, 28*b* of FIG. 8. Warp threads 10 are fed via a warp beam 32 to a shedding device 34. The shedding device 34 contains a jacquard device 36 which can be controlled according to the pattern by a computer control 38. The jacquard device 36 contains heddles 40 which control the individual warp threads 10 via eyes 42. Weft threads 12 are inserted via a weft insertion device, not illustrated in anymore detail, into the weaving shed 44 opened by the shedding device 34. The weft insertion device is assigned a thread selection device 46 which is connected to the computer control 38 and which feeds threads 48*a*, 48*b*, 48*c* in the desired color to the weft insertion device. By means of a weaving reed 50, the weft threads 12 are beaten up at the cloth verge 52. The weaving reed 50 contains reed dents 54 which are arranged in parallel and ensure a parallel guidance of the warp threads 10 in the desired warp thread density. The scarves thus produced run through a temple 56, in order to maintain them at the desired width. The temple 56 is followed by a separating device 30 in order to separate the scarves 28*a*, 28*b* from one another, as indicated by reference to FIG. 8. A cloth take-up 58 ensures the necessary longitudinal tension of the scarves at the weaving machine and takes them up. A thermosetting device 60 makes the scarves 28*a*, 28*b* stress-free before they leave the cloth take-up. A following cross-separation device 62 severs the finished scarves to the desired length.

The invention claimed is:

1. A patterned scarf comprising: a first fabric layer and a second fabric layer which are interwoven along their edges, weft threads spaced-out between warp threads of a common color so as to form as least one of colors and patterns in the scarf, the warp threads consisting of a textured yarn composed of chemical fibers, at least a number of the weft threads consisting of acrylic staple fibers, and further comprising a lettering region and a picture region, weft threads of the lettering and picture regions being different in terms of fineness and material from other weft threads of the scarf.

2. The scarf as defined in claim 1, wherein the textured yarn of the warp threads has nontwisted fibers which lie essentially open in parallel and which are all swirled at intervals of 0.5 to 5 cm.

3. The scarf as defined in claim 2, wherein the non-twisted fibers are swirled at intervals of 0.8 to 1.2 cm.

4. The scarf as defined in claim 1, wherein the warp threads have a fineness of 55 to 550 dtex.

5. The scarf as defined in claim 4, wherein the warp threads have a fineness of 160 to 180 detex.

6. The scarf as defined in claim 1, having a warp density of 40 to 60 threads/cm and, in each fabric layer, a weft density of 20 to 35 threads/cm.

7. The scarf as define in claim 6, wherein the warp density is 48 threads/cm.

8. The scarf as defined in claim 1, wherein the warp threads consist of one of polyester and polyamide.

9. The scarf as defined in claim 1, wherein in at least one of a color change and pattern change of a pattern part, the weft threads run from one fabric layer to the other fabric layer so as to connect the fabric layers.

10. The scarf as defined in claim 1, and further comprising an individually configured pattern region.

11. A patterned scarf comprising: a first fabric layer and a second fabric layer which are interwoven along their edges, weft threads spaced-out between warp threads of a common color so as to form as least one of colors and patterns in the scarf, the warp threads consisting of a textured yarn composed of chemical fibers, at least a number of the weft threads consisting of acrylic staple fibers, and further comprising an outer wall thread along longitudinal edges of the scarf that is an adhesive warp thread which connects crossing weft threads.

12. The scarf as defined in claim 11, where in the outer wall thread is a thermoplastic material.

13. A patterned scarf comprising: a first fabric layer and a second fabric layer which are interwoven along their edges, weft threads spaced-out between warp threads of a common color so as to form as least one of colors and patterns in the scarf, the warp threads consisting of a textured yarn composed of chemical fibers, at least a number of the weft threads consisting of acrylic staple fibers, wherein at least a first and a last weft thread along a transverse edge of the scarf are adhesive weft threads which connect crossing warp threads.

14. The scarf as defined in claim 13, wherein the adhesive weft thread consists of a thermoplastic material.

15. The scarf as defined in claim 1, comprising of fringes along transverse edges of the scarf, the fringes being formed by the warp threads.

16. The scarf as defined in claim 1, comprising of fringes along longitudinal edges of the scarf, the fringes being formed by projecting weft threads.

17. The scarf as defined in claim 1, wherein the fabric layers are roughened.

* * * * *